US007514378B2

(12) United States Patent
Howland

(10) Patent No.: US 7,514,378 B2
(45) Date of Patent: Apr. 7, 2009

(54) CONTINUOUS AND DISCONTINUOUS PROTECTIVE FIBER COMPOSITES

(75) Inventor: Charles A Howland, Temple, NH (US)

(73) Assignee: Warwick Mills, Inc., New Ipswich, NH (US)

( * ) Notice: Subject to any disclaimer, the term of this patent is extended or adjusted under 35 U.S.C. 154(b) by 224 days.

(21) Appl. No.: 11/071,141

(22) Filed: Mar. 3, 2005

(65) Prior Publication Data

US 2005/0197024 A1 Sep. 8, 2005

Related U.S. Application Data

(60) Provisional application No. 60/560,475, filed on Apr. 8, 2004, provisional application No. 60/549,647, filed on Mar. 3, 2004.

(51) Int. Cl.
*B32B 27/12* (2006.01)

(52) U.S. Cl. ..... 442/134; 442/135; 428/911; 2/2.5; 89/36.01; 89/36.02; 89/36.05

(58) Field of Classification Search ..... 442/134, 442/135; 428/911; 2/2.5; 89/36.01, 36.02, 89/36.05

See application file for complete search history.

(56) References Cited

U.S. PATENT DOCUMENTS 5,565,264 A 10/1996 Howland
5,837,623 A 11/1998 Howland
5,976,996 A 11/1999 Howland
6,266,818 B1 7/2001 Howland et al.
6,543,055 B2 4/2003 Howland et al.
6,548,430 B1 4/2003 Howland
6,668,868 B2 12/2003 Howland et al.
6,693,052 B2 2/2004 Howland
6,720,277 B1 4/2004 Howland
6,834,685 B2 12/2004 Hannigan et al.
6,840,288 B2 1/2005 Zhu et al.
6,911,247 B2 6/2005 Howland
2003/0129900 A1* 7/2003 Chiou ..... 442/134

OTHER PUBLICATIONS

PCT International Search Report dated Aug. 7, 2006 of International Application No. PCT/US05/07402 filed Mar. 3, 2005.
US 6,861,120, 03/2005, Howland (withdrawn)

* cited by examiner

*Primary Examiner*—Ula C Ruddock
(74) *Attorney, Agent, or Firm*—Vern Maine & Associates

(57) ABSTRACT

A composite fabric, multi-layer protective panel alternative to an exclusively fine denier, continuous filament yarn protective fabric, multi-layer protective panel. Fabric layers consist of warp and fill sheets of continuous filament yarn of relatively higher denier at a relatively lower cover factor that have their yarns interlocked in a woven pattern by overlapping warp and fill sheets of staple yarns of relatively lower denier, thus raising effective cover factor. Staple yarns have a conspicuous amount of hairiness for greater yarn stability. Ballistic performance is enhanced by depositing a molten mass of fiber material and protruding staple fiber filament ends on a striking projectile upon impact on outer layers, and transporting the additional mass into the panel with a higher coefficient of friction.

20 Claims, 9 Drawing Sheets

CONTINUOUS AND DISCONTINUOUS PROTECTIVE FIBER COMPOSITES

PRIORITY CLAIM

This application relates and claims priority to U.S. applications Ser. No. 60/549,647 filed Mar. 3, 2004, and Ser. No. 60/560,475, filed Apr. 8, 2004.

FIELD OF INVENTION

The invention relates to protective fabrics, and more particularly, to a composite material constructions using continuous and discontinuous fiber yarns in combination.

BACKGROUND OF THE INVENTION

The current practice in protective fabrics is nearly universal in its use of continuous filament fiber for ballistic, spike and knife protection. Yarns of the continuous filament type in para-arimid, ultra high molecular weight polyethylene and PBO are all in common use in woven webs and laminated webs. The range of deniers in these products typically runs from 200 d to 1500 d (denier). These webs are used in multi-layer soft panel assembly to provide protection to the users. Types of garments include vests, neck, groin, leg and arm protection as well as other protective equipment.

The use of soft fabric based protective systems are based on the progressive reduction of penetrator energy. The ballistic case is typical. The energy of high velocity bullets is reduced in a progressive manner. Each layer in a soft ballistic panel is deflected by the ballistic impact. As each layer is displaced and reaches it tensile limit the energy of the ballistic impact is reduced. The basic relationship of force times distance (F×D) governs the reduction of ballistic energy performed by a soft panel. It is useful to think of this process as a series of force peaks as each fabric layer is deflected and penetrated.

The design of soft ballistic panels is based on this layered form of protection. The more layers that are used for a given weight of fiber, the higher the ballistic protection. In this way a soft, multi-layer panel that is properly supported, can absorb the energy of even non-deformable projectiles.

In a notable exception to the continuous filament fiber art, the inventor has developed the first staple based protective fabrics offering equivalent levels of spike protection. Application Ser. Nos. 09/943,744 and 09/943,749, both filed Aug. 30, 2001, are incorporated herein by reference.

The capital equipment needed to produce high strength, continuous filament fibers is expensive. The linear quantity requirement for a fabric using lower denier, smaller diameter filament fibers is proportionally higher than for using higher denier filament fibers, since it is made on the same machinery. The cost and availability of fine denier continuous filament fiber fabrics is therefore seriously affected.

What is needed is a less costly composition of high strength fibers, and less dependence on very fine or smaller denier continuous filament fibers; in short, a new fabric design that will provide generally equivalent performance with regard to weight, yarn stability, and penetration protection, as do the present low denier, continuous filament fiber fabrics of the prior art.

SUMMARY OF THE INVENTION

The subject of this invention disclosure is the novel use of multiple yarn types to produce protective fabrics. This new fabric design comprises a combination of small and large yarn types of both continuous and staple fiber. The invention solves a number of challenging technical concerns in the design of protective materials. Because performance of protective materials is improved by the use of many thin light-weight layers; a typical one lb/ft$^2$ multi layer panel can be expected to have the best performance at the highest obtainable layer count. In general, this contemporary understanding of the art suggests and has led to the use of relatively finer denier yarn to enable the production of light fabrics. The current trend is towards the use of 200-600 denier yarns. This allows panel layer counts of up to 70 layers for a panel weight of about 1.0 lb/ft$^2$.

The central issue in this design evolution to higher layer counts and finer denier is that greater lineal quantities of fiber are needed, finer denier fiber if this type is more expensive to produce, and this has raised the cost of protective fabric panel systems.

It is therefore an aspect of the invention to be able to utilize a more cost effective combination of available materials to achieve comparable fabric performance, by using novel and unobvious composite fabric designs that include the use of sheets of relatively higher denier continuous filament yarns at relatively low cover factors interlocked in a woven pattern by sheets of staple yarns, where the lower cost staple yarns provide a locking effect on the continuous yarns and raise the total cover factor and yarn stability of the composite fabric to a comparable level as a fabric of only lighter continuous filament yarns, at a comparable or lower unit weight.

Another aspect of the invention is to provide a composite fabric of the general design described above, where the staple yarns have a conspicuous amount of hairiness, protruding filament ends that provide a further degree of inter yarn and inter layer adhesion that enhances the ballistic and general penetration resistance of a multilayer panel of these composite fabrics as compared to exclusively continuous fiber fabrics.

Yet another aspect of the invention is the ability of the outer layers of a composite fabric panel described above to form and deposit a molten mass of fiber material and protruding filament ends on the face of a ballistic projectile at impact, thereby elevating its coefficient of friction so during the subsequent transporting of the molten mass by the projectile deeper into the fabric panel, the interior layers are able to absorb more energy from the projectile and thus stop it sooner. Other useful aspects of the invention will be apparent from the appended figures and the description and claims that follow.

DETAILED DESCRIPTION OF THE PREFERRED EMBODIMENT

The invention is susceptible of many examples and embodiments. The description and appended figures are intended to be illustrative and not limiting of the invention or the claims that follow.

The industry goal in the making of protective fabrics of this type is to have a web that weighs less than 4.0 oz/yd$^2$ and still retains enough yarn stability for manufacturing and for penetration performance. The use heavy denier (1500 d-600 d) in light fabrics is limited by the weave density and yarn stability of the cloth produced with these yarns. The limitation of denier size in the prior art in achieving a 4 oz objective is due to the limited amount of fiber and the resulting limited degree of cover of the yarn in the web imposed by the weight limit. If there is not enough fiber, in other words not a high enough cover factor to assure yarn stability, the shifting of the yarns in the plane of the fabric becomes an issue that affects performance and suitability of the fabric.

Figure 3:
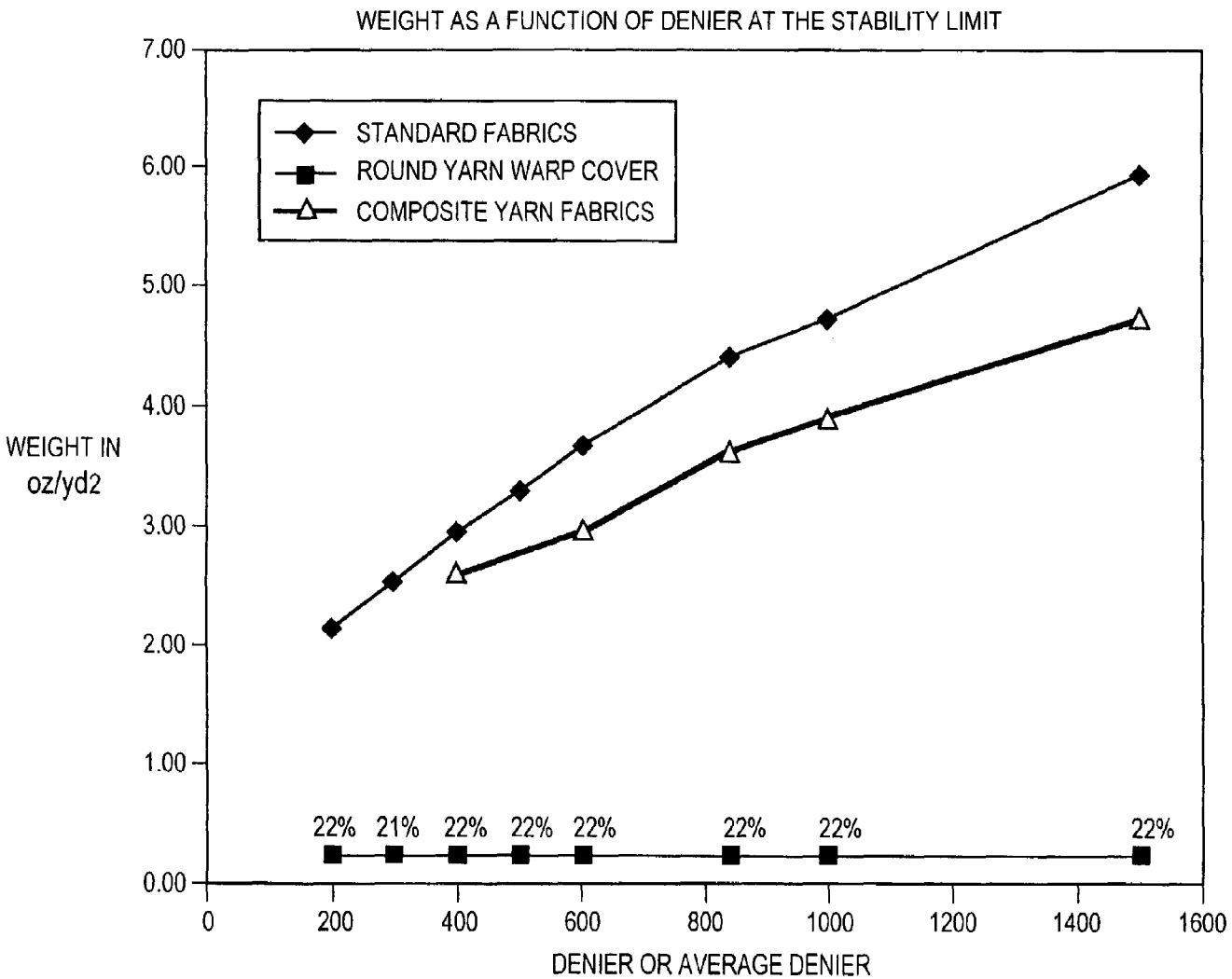
FIG. 3 is line graph of fabric weight as a function of denier at or near the yarn stability limit by percentage of cover factor.

The applicant has discovered the unexpected result that a composite fabric having a warp sheet or layer of alternating higher denier, high strength filament yarns and lower denier staple yarns, interwoven with a cross direction or fill sheet or layer of alternating higher denier high strength filament yarns and lower denier staple yarns, as can be seen from FIG. 3, have weights under 4 oz/yd$^2$ (up to 1000 average denier) where standard fabrics of the same base denier and cover factor are heavier.

The use of round yarn diameter is a useful measure to determine the total coverage of the yarn in a web design. It has been determined that a range of 20-23% cover in the warp and fill is the minimum stability range suitable for practical unlaminated and/or coated webs, in order to facilitate manufacturing and provide adequate penetration resistance. Using this range as a set point, we can see again from FIG. 3, that the lighter the denier the lighter the fabric that can be manufactured at this stability limit.

The series of fabrics shown in the weight/denier chart of FIG. 3 are all within the expected minimum stability range at about 22% cover factor. In the prior art practice the deniers shown have been processed at higher cover factors for most protective applications such as ballistics. For example the 840 denier yarn has been process at 31% cover in most prior art cases. The end count in warp and fill is not at the 20×20 epi show in the chart but more typically at 28×28 epi. This typically higher end count usage has the effect of increasing the fabric weight/denier differential shown in FIG. 3, increasing the advantage resulting from the composite fabric design of the invention. This effect is in part the result of the current fabrics being made only of continuous filament yarn. Of yarn types, continuous filament is known to contribute the lowest stability to a fabric for a given denier as compared to other fibers, and is therefore woven at a higher cover factor than the threshold range of the invention.

As noted, yarn denier and end count are not the only factors that affect the stability of the fabric weave. The type of yarn material, the amount of twist, the size of the filaments, the interlace of the filaments, the presence of lubricants, and the compaction of the web by calendering, all affect the stability limit of the yarn in the fabric to some degree.

Figure 1:
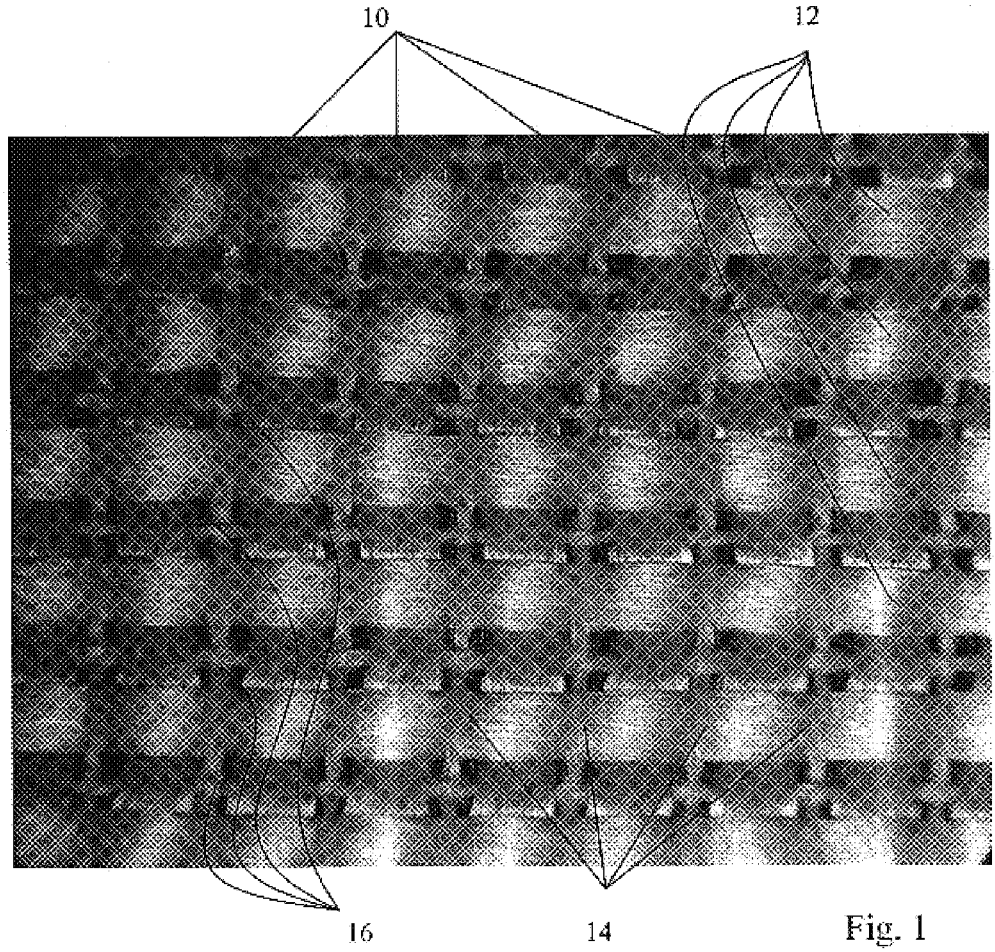
FIG. 1 is top view micrograph of a section of one embodiment of the invention, clearly illustrating the geometry of the composite weave of larger, (wider in the micrograph) continuous filament and relatively smaller, (narrower in the micrograph) non-continuous filament yarns.

The invention provides an alternative fabric construction to light webs and light deniers. Using the composite fabric design of the invention, light stable webs can be produced from the heavier yarns. Referring to FIG. 1 as an example, an embodiment of the invention utilizes a patterned weave of two yarns in each direction; a primary yarn of relatively higher denier, and a locking yarn of relatively lower denier, in each of warp and fill directions.

For the purpose of describing this embodiment, the warp and fill direction primary yarns can be considered as a first component of the fabric design, and the related geometry of the locking yarns can be considered as a second component of the fabric design. The primary yarn is a continuous filament yarn comprising filament that typically has greater than 10 gram/denier tenacity. Examining the primary yarns first, there is illustrated in FIG. 1 a sheet or array of primary warp yarns 10 and a sheet or array of primary fill yarns 12. It will be apparent from close review of FIG. 1 that in this embodiment, the respective sheets of primary warp yarns 10 and fill yarns 12 are not directly interwoven, but rather lie one sheet atop the other. In other embodiments, these primary yarns may have a discrete woven pattern within the fabric.

Then considering the locking yarns and their contribution to the design; the locking yarn of this embodiment is a staple yarn, meaning a yarn comprised of non-continuous filaments and/or fibers. Staple spun, cotton system, worsted or stretch broken material are among the suitable materials, although continuous filament fibers may be used as well. There is illustrated in FIG. 1 a sheet or array of locking warp yarns 14 and another sheet or array of locking fill yarns 16. Close observation will confirm that these two sheets of locking yarns are not directly interwoven either. Rather, by the alternating orientation of the primary and locking yarns in both directions in the web, the warp and fill arrays of heavy denier primary yarns are locked into an intimate relationship one atop the other by the alternating yarn placement and overall weave pattern of the warp and fill arrays of lighter denier, staple fiber, locking yarns.

In other embodiments, the fabric weave pattern may be varied, but a uniformly alternating displacement of primary and locking yarns in one or both directions, at the optimal range of cover factor, will yield an average yarn weight less than that of the primary yarn, at a more favorable weight than an otherwise homogenous yarn fabric.

The effective web weight of the embodiment of FIG. 1 is determined by the average effect of the primary and locking yarn deniers. Because the smaller locking yarn is made of staple or stretch broken fiber, the fabric can still be homogeneous in fiber type if desired. However because the smaller second yarn is produced from non-continuous fiber, the cost penalty of exclusively using a relatively finer (more costly) denier high performance yarn of continuous filament is avoided by the ability to use a larger denier (lower cost) continuous fiber yarn in combination with the smaller denier staple (lower cost) locking yarn. In addition to the advantage from the use of smaller denier yarn in combination with larger denier yarn for less-than-larger yarn weight, the invention captures the economic advantage of using heavy denier continuous filament yarn in the large yarn portion of the composite system, as well as less of it.

Because weave stability is a critical element in this invention, in several embodiments the composite weave design is plain 1×1 weave design. Referring again to FIG. 1, it will be seen that this embodiment uses of all the potential crossing points, or locking points as they may be called, available to the alternating primary and locking yarns in both directions of the weave pattern. This maximizes the stability for a given end count in warp and fill. A basket weave, in distinction, uses only 25% of the available crossing points; warp yarns crossing over the web from one side to the other between every second fill yarn rather than between every one, therefore using only ½ the available crossing points; and fill yarns similarly oriented to use only ½ their available crossing points between warp yarns. The basket weave is therefore an inherently less stable fabric, if all other parameters are considered to be the same.

Restating one aspect of the above embodiments, two types of yarn are processed with a uniformly mixed orientation, not necessarily alternating 1 to 1, in each direction of the web. For example, there might be a 2 locking, 1 primary; or a 2 primary, 1 locking yarn repetitive pattern in either or both of warp and fill directions. But generally speaking, there is a relatively large denier, high strength, continuous filament fiber primary yarn used in each machine direction, alternating in the web in some repeating manner with a smaller denier, staple type, locking yarn in each machine direction, as illustrated in FIG. 1.

Figure 2:
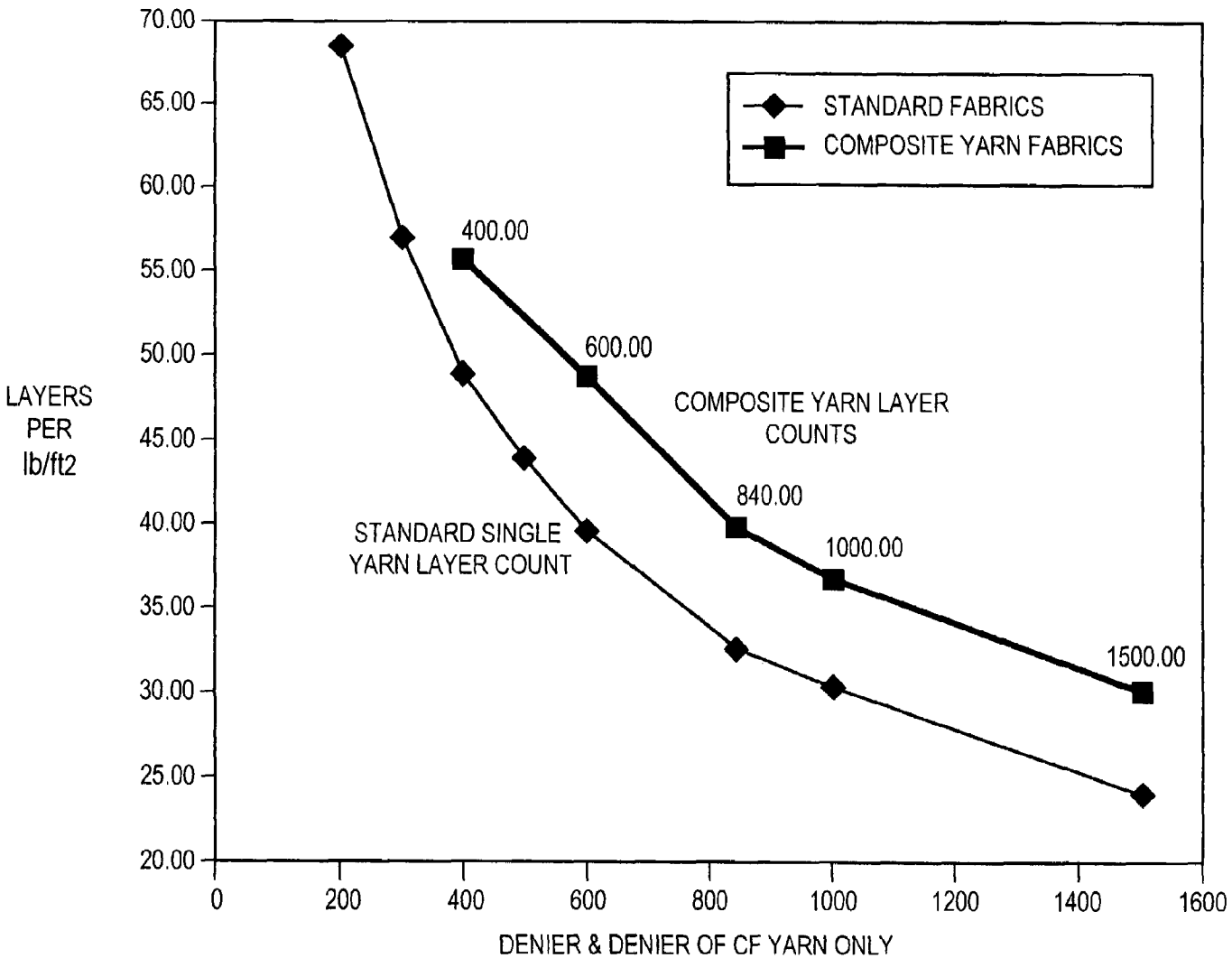
FIG. 2 is a line graph illustrating the equivalent layer count of webs versus denier of yarn, for standard fabrics of a single denier, and for composite fabrics of two yarn weights.

Referring now to FIG. 2, it can be seen that the composite fabric of the invention has significant advantages in layer count over conventional homogenous designs, due to the weight advantage. For example to obtain the same layer count in a conventional fabric design, as the composite 840 denier design of the invention, a more costly 600 denier yarn would have to be used. Similarly, to obtain the same layer count as the composite 600 denier design of the invention, 400 denier yarn would be necessary. These comparisons are based on the minimum ends per inch e.p.i. design at the theoretical stability limit for the continuous filament designs. In practice the higher e.p.i. counts and cover factor for these fabrics are selected to achieve sufficient stability. This practice has the effect of improving the weight advantage of the composite fabric of the invention.

Many embodiments of the invention are plain weave and also balanced in end count density. Balanced or equal end count of each yarn type in each of the warp and fill is generally preferred. A balanced design allows fabric to be assembled in the protective panels without a specific orientation. However the use of imbalanced designs where the cover is higher in the warp or fill is within the scope of the invention.

As in the example of FIG. 1, in some embodiments the smaller locking yarns comprise staple fiber that exhibit hairiness as a result of the terminations of the filament segments. This hairiness improves the stability of staple yarn as a locking yarn over continuous filament material. The filament terminations in the warp and fill locking yarns tend to interlock and hold the primary yarns in place. Because of this inherent improvement in the stability of the design, the actual cover factor and hence the weight, can be further reduced as low as the effective stability permits.

Figure 4:
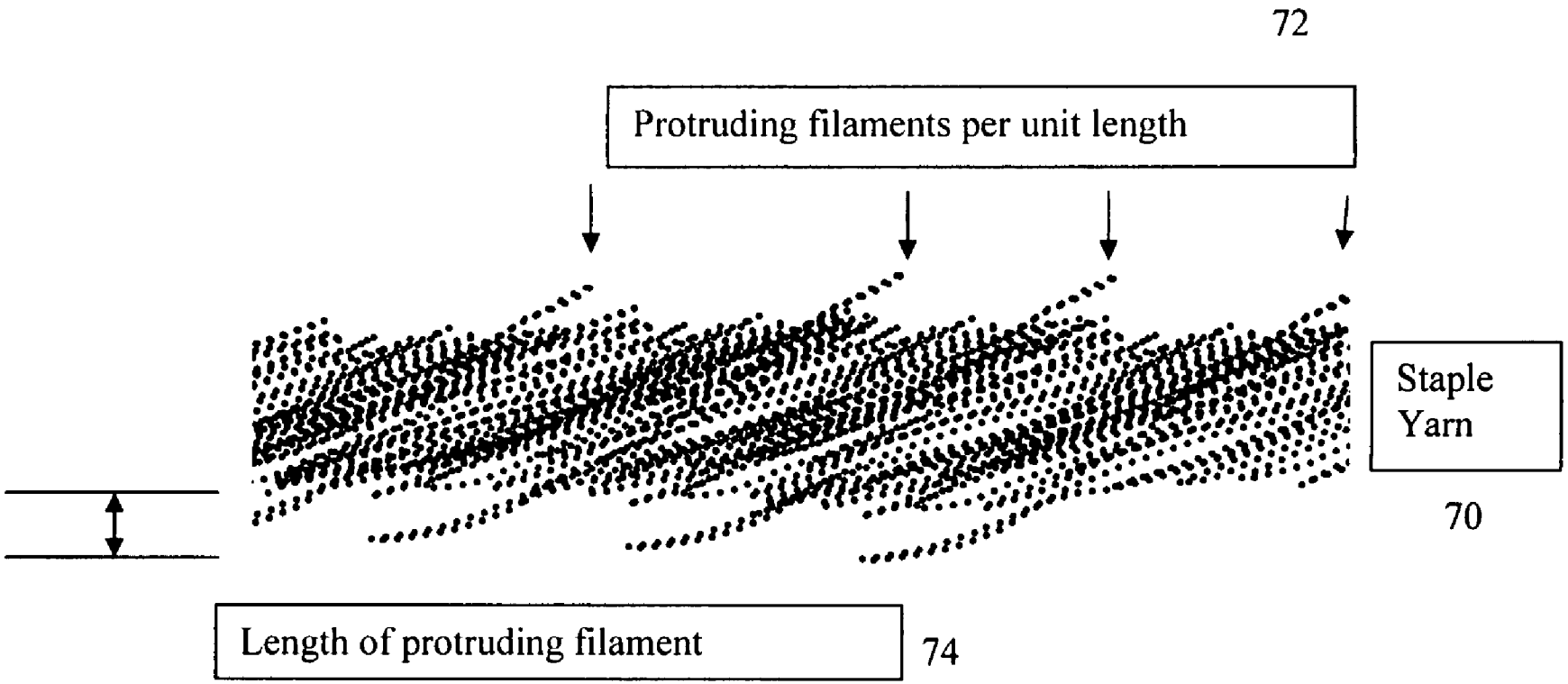
FIG. 4 is an illustration of hairiness due to filament ends protruding from a staple yarn.

Referring now to FIG. 4, hairiness is illustrated as a feature or component of a staple yarn. "Hairiness" can be quantified by various optical methods such as those used by Murrata, Inc. in their test equipment. Hairiness has two components; first, the number of filaments ends 72 that protrude from the bundle 70 per unit length, and second, the length 74 of these protruding filaments. The variation in thick and thin zones in spun yarn due to hairiness is usually defined as "evenness". This yarn characteristic is generally measured by capacitive methods.

The primary design variables for control of hairiness in order of importance are: DPF (Denier per fiber) of the fiber or fibers in the yarn as blended (a large DPF equates to hairier yarns); staple length range (more shorter filaments equates to hairier yarns); twist level; traveler type; and spinning speed.

For the purposes of this invention the highest achievable level of hairiness should be used consistent with the following limitations. Hairy yarns tend to cause processing issues such as lost ends and other mechanical defects. Hairiness must be controlled to limit yarn bundle defects while offering the highest weave stabilization effect. Because of the competing requirement to keep the protective system light in weight, yarn size should generally be as small as possible. As has been described, finer denier per filament fiber allows for finer yarns. However larger dpf (denier per fiber) fiber has a stiffer cross section and therefore provides a higher level of stabilization. The spinning process tends to drive higher dpf fiber to the outside of a yarn. This effect makes intimate blends of a 2 or more dpf fiber attractive for creating large dpf protruding filament while at the same time keeping the required yarn size quite small.

The number of available filament ends is also relevant. Some filament ends in a staple yarn are confined and not exposed along the yarn due to inter-bundle contact within the yarn. In a two bundle yarn, there is roughly a 30% loss of exposed filament ends, due to this blinding factor. The calculation for approximating the available number of exiting filaments or filament ends per inch FE in a staple yarn, where the blinding factor is assumed to be 0.6, is as follows:

$$(\text{filaments/bundle})/\text{staple length(inches)} \times \text{bundles/yarn} \times 0.6 = FE$$

Although there is no particular minimum number, in the preferred embodiments described there are 60 or more exiting filaments per inch of yarn. In general, the staple yarn cross-section preferrably has approximately 70 filaments or more per bundle, with a typical bundle group of two per staple yarn. Assuming an average staple filament length of 1.5 inches, there are approximately 50 staple filament ends exiting each bundle every inch of yarn length.

Figure 5:
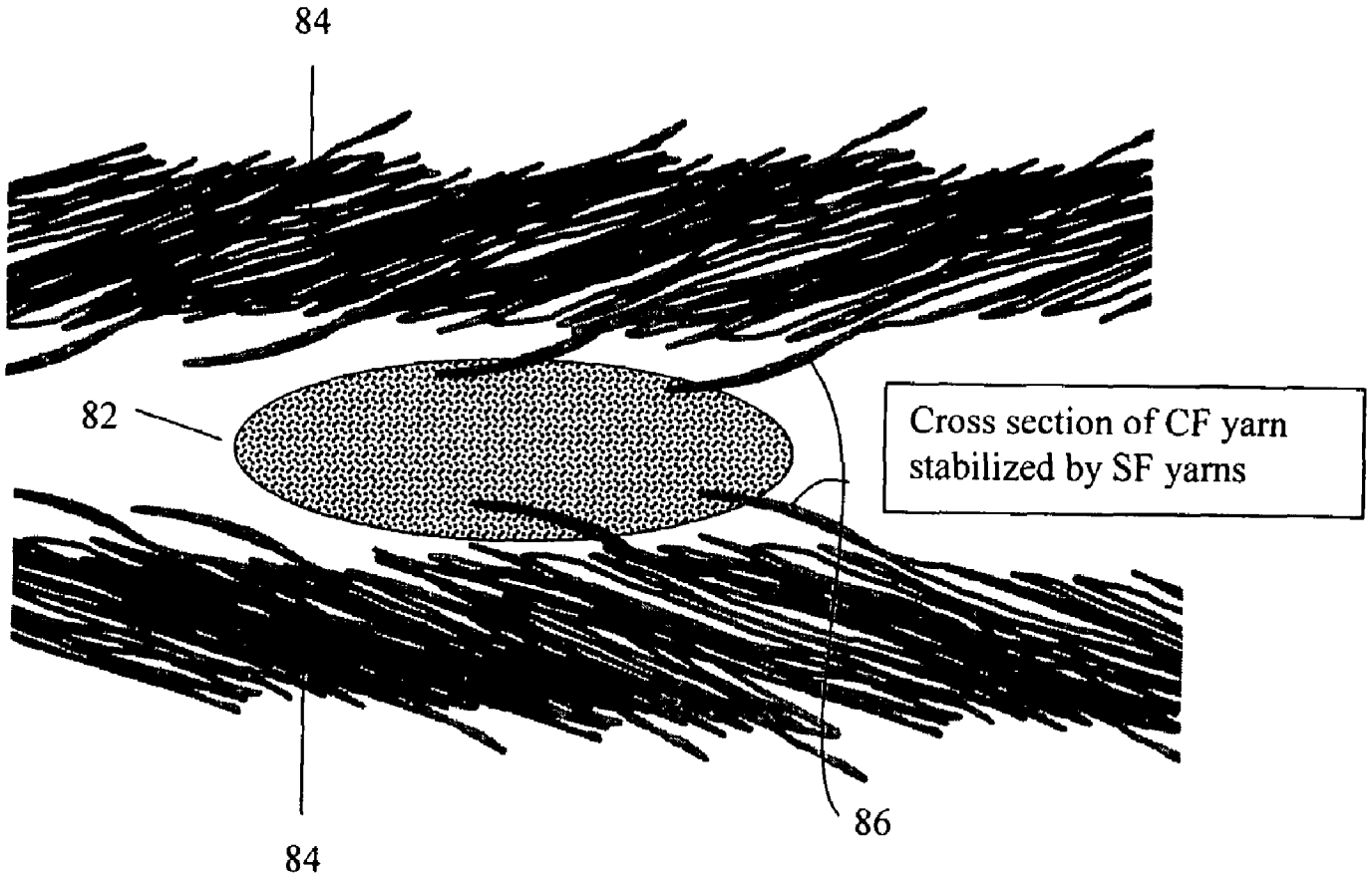
FIG. 5 is an illustration of the protruding filament ends of two staple yarns engaged with an intersecting yarn bundle shown here in cross section.
Figure 6:
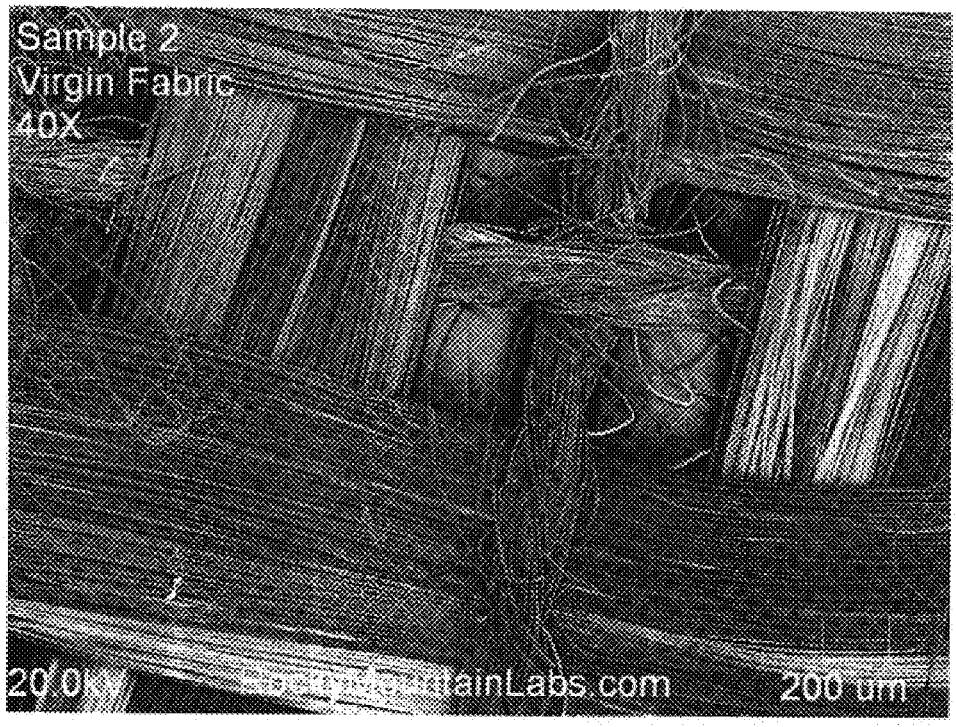
FIG. 6 is a micrograph of a close up of adjacent crossing points of a continuous fiber large yarn and a smaller staple yarn with protruding filament ends, interwoven in a composite weave example of the invention.

Referring now to FIG. 5, there is illustrated and demonstrated by the micrograph of FIG. 6, a close up of a continuous fiber (CF) primary yarn 82 in cross section being crossed by smaller locking staple (SF) yarns 84, with protruding filament ends 86, engaging primary yarn 82 such that the hairiness of the locking yarns contributes to the stability of the woven structure.

The stabilizing effect of hairiness of the staple fiber can be enhanced after the web is manufactured in various ways by finishing methods. Needle looms as are used in the manufacture of non-woven felts are useful. Needling is used to increase the content of protruding fiber and to create interconnections between the layers in a multi layer system. Brushing, air blast lofting and other similar finishing processing operations have the same benefits of increasing the volume of protruding fiber. In one embodiment of the invention, in the case of intimate blend staple yarns, one of the fibers in the yarn can have a lower melt point which can be used as a bonding agent for the balance of the fiber.

Figure 8:
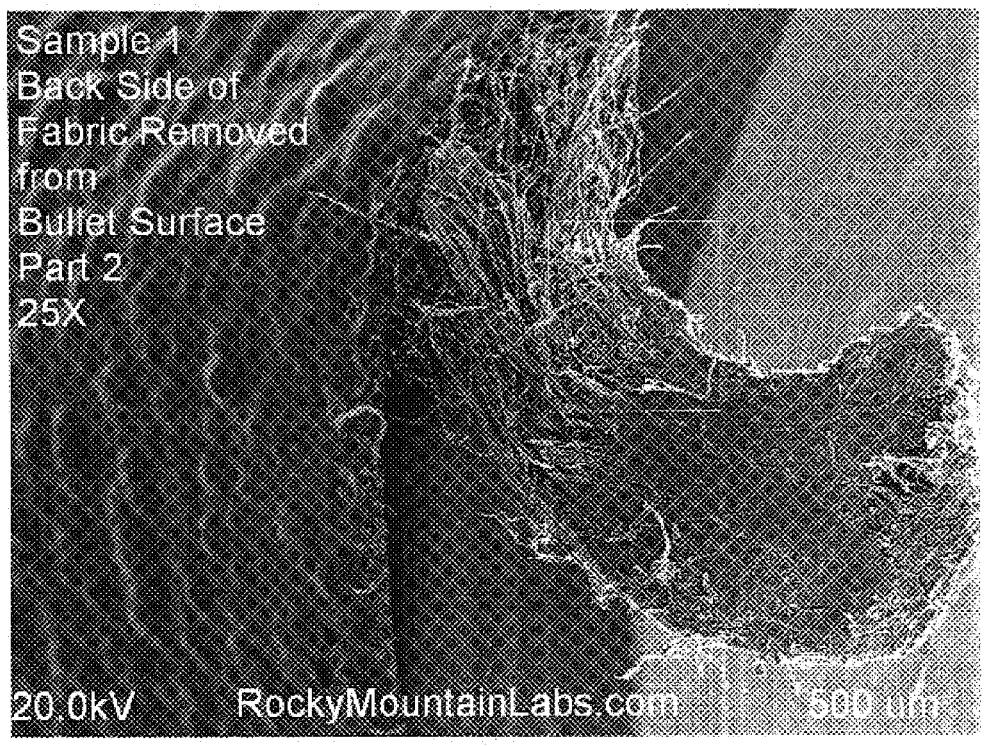
FIG. 8 is a micrograph of the back side of the fiber mat residue of FIG. 7.
Figure 9:
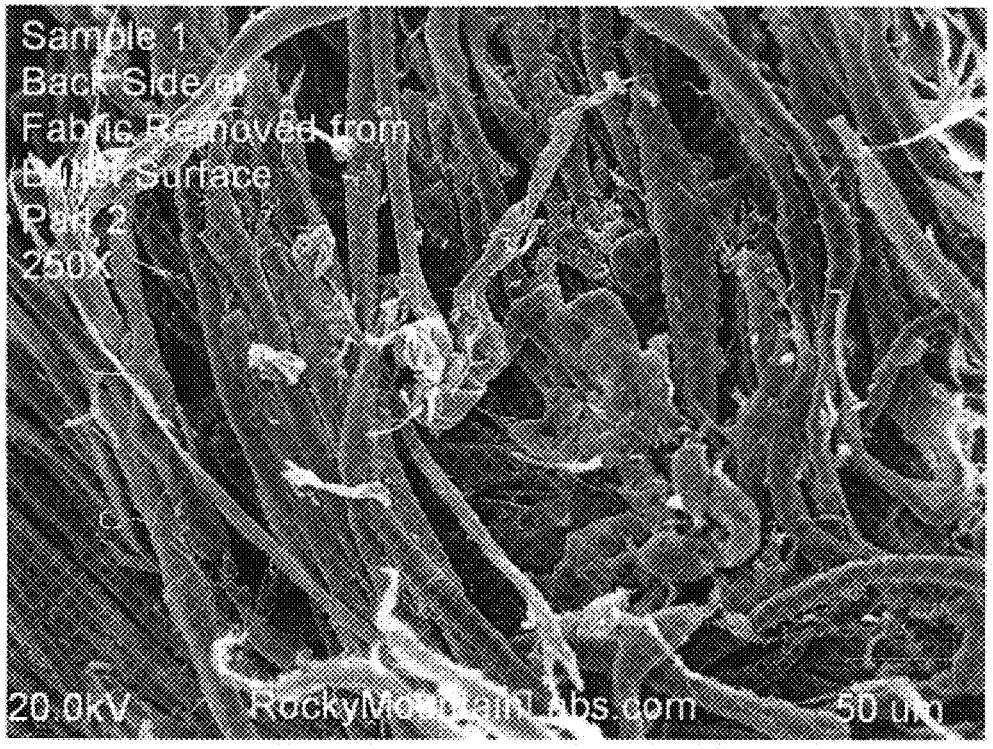
FIG. 9 is a micrograph close up of the transition area of the melt zone of FIG. 8.

Referring now to FIGS. 8 and 9, there are illustrated by micrographs the bullet side and the back side of the accumulated deposit of material from the fiber mat of the invention, taken from the nose of a projectile after live fire testing on the fiber mat with a 9 mm FMJ round at 1500 fps (feet per second). Actual staple fiber yarns interact with the ballistic impact event in a novel way.

One aspect of the invention is the energy dissipation occurring upon impact of the projectile on the composite fabric layers of the invention. In the ballistic impact the bullet strikes the front face of a protective fiber mat panel. The energy of the impact is defined by the mass and velocity of the projectile. In order to stop the projectile this energy must be converted into heat by friction with the protective panel.

The initial resistance of the panel causes a deforming of the projectile in the case of typical lead and copper jacketed lead rounds. This deformation and the concurrent friction as the first layers of the panel are penetrated generates high temperatures at the fiber/penetrator interface. In addition, the pressures at this interface are very high. The combined effect creates conditions that melt and flow the otherwise very heat resistant fiber. The molten para-aramid fiber for example is a very viscose material and provides an excellent frictional surface which can absorb high energy transfer rates. Para-aramid fiber materials are used for clutch and breaking surfaces for this reason. The larger the mat of filament debris that accumulates on the projectile face during its journey through the outer layers of the fiber mat panel, the better the frictional energy transfer from the bullet to the further layers of fabric in the panel.

Figure 7:
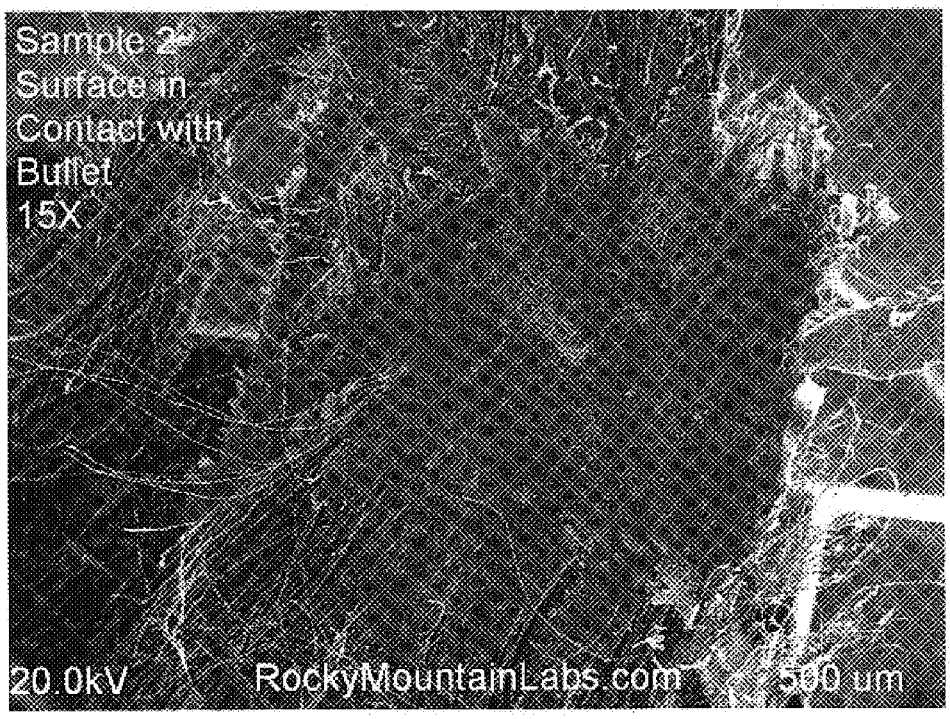
FIG. 7 is a micrograph of the bullet side of the fiber mat residue accumulated on the bullet during a live fire test shot on the mat with a 9 mm FMJ round at 1500 fps (feet per second).

In contrast to the invention, in the case of a protective panel of the prior art, constructed from layers of normal, continuous filament fabric, the filaments tend to break in a single location and do not become attached to the nose or leading face of the projectile. However, according to the instant invention, as is evident in the micrograph of FIGS. 7, 8 and 9, there is an entanglement of fiber segments in the residual material that accumulates on the projective, with fiber ends extending from the molten central area of the residue.

It is a subtle and unexpected result, and an important aspect of the invention, that the short staple fibers of the early or outer layers are disrupted by the shock wave of impact and become readily entangled with the melt layer on the bullet face, with filament ends protruding about the periphery of the melt. This donor fiber from the staple locking yarn accumulates on the bullet face as additional layers are penetrated. This mat of debris substantially increases the total frictional area involved with the transfer of the kinetic energy into heat. The unanticipated result of testing is that the combined staple and continuous fiber fabrics of the invention are approximately 5-20% more efficient at stopping ballistic threats than the same mass of continuous fiber alone. This amount of incremental improvement in performance, achieved in this manner, is very significant.

Referring particularly to the close up of FIG. 10, the detail of the melt transition zone at the skirt of the fiber mat vividly exhibits the extension of frictional elements from the molten area outward. The formation of this melt material from the donor fiber from the staple yarn tends to help accumulate fiber in the mat. The mechanism is believed to be hot melt adhesion of fiber to the molten material.

The creation of a fiber mat more than 2 filaments thick is an important aspect of this invention. This fiber mat moves with the penetrator through the first few layers of fabric. When the ballistic package was inspected after ballistic testing, a discrete fiber mat patch was isolated from the front face of the bullet. This is in distinction to a normal ballistic impact where the bullet face is in intimate contact with the next or final intact layer of fabric. It is a key aspect of the invention that the difference in the fabrics of the invention is the resulting transporting of a molten mass of fiber material and protruding filament ends of staple fiber by the projectile from the strike face of the panel into the lower layers of panel. The frictional performance of the fabric is improved by the transport of the bullet fiber material that accumulates on the projectile early in the deceleration process.

To summarize some key points, in ballistic practice, hairy staple fiber contributes three important benefits to the fabric design of the invention: inter-yarn stability for light webs when used in suitable combinations with heavier continuous filament yarn types; intra-layer stability by the same mechanism for improved ballistic performance; and donor filament for ballistic fiber mat on the face of the projectile.

In practice, yarns of less than 70 denier are difficult to spin using para-aramid and other high strength fibers. In one embodiment these staple yarns are plied for strength and used in combination with 840 denier continuous filament yarn to produce an all para-arimid web. In this embodiment the spun 150 d (70/2 cc) locking yarn is combined with 840 denier primary yarn in a plain weave at the stability limit of 21% cover at 28×28 e.p.i. total count. This yields a fabric of 500 denier average yarn size and a web weight at the stability limit similar to a more typical all 500 denier, continuous fiber fabric, and with a 1.6 oz/yd$^2$ advantage in weight per layer over an all 840 denier fabric at the same cover factor. For the purposes of this disclosure and the claims that follow; cover factor means equivalent round cover factor as is amply discussed above and in this applicant's prior patents which are herein incorporated by reference, and is well understood in the art.

In another embodiment the primary yarns chosen are 600 denier continuous filament combined with the same 150 denier (70/2 cc) staple locking yarn of the previous embodiment, in a plain weave with 30×30 total e.p.i. (ends per inch) and a cover factor of 21-22%. This design yields a web with nearly 50 layers per lb/ft$^2$ at the same web weight. This is a 1.3 oz/yard$^2$ weight advantage and an advantage of almost 10 layers for the typical 1.0 lb/ft$^2$ package of homogenous yarn type, prior art fabrics.

In yet another embodiment the locking yarn is not a of a high performance type. This yarn can be chosen from a wide range of fiber type including staple and continuous filament nylon and polyester materials. This embodiment does not provide a lowest weight solution. However the cost advantage of this embodiment is significantly improved as a result of the lower cost per unit of the locking yarn material. The layer count advantage is delivered at a small increase in total mass. This design uses 170 denier (60/2 cc) polyester fiber of 1 denier/filament for the locking yarn. This embodiment uses a 1000 denier para-arimid yarn as the primary yarn in the alternating pattern of FIG. 1, in a one for one plain weave with 26×26 total end count and a cover of 23%.

In still another preferred embodiment the smaller denier locking yarn is of a para-arimid type, stretch broken, 200 denier fiber, and the larger continuous filament primary yarn is of 1000 denier PBO fiber. This composite fabric is woven at 13 epi for each of the two yarns in the alternating pattern of FIG. 1 for a total count plain weave of 26×26 epi.

Referring now to Table 1 below (spanning two pages), the range of parameters of other listed embodiments will be appreciated by those skilled in the art as illustrative and not limiting of the nature and scope of the invention.

TABLE 1

| Preferred embodiments | Continuous filament fiber type: MD mat'l type | Continuous filament fiber type: CMD mat'l type | Staple fiber, preferred values: 1. <1.0 dpf 2. <3" staple 3. >10 gpd: MD mat'l type | Staple fiber, preferred values: 1. <1.0 dpf 2. <3" staple 3. >10 gpd: CMD mat'l type | Crossing design cf: MD | Crossing design cf: CMD | Crossing design sf: MD | Crossing design sf: CMD | Round cover factor: MD | Round cover factor: CMD | Primary application |
|---|---|---|---|---|---|---|---|---|---|---|---|
| #1 Multi layer no connecting yarns | Para Aramid 400d = 3000d <1.0 dpf | Para Aramid 400d = 3000d <1.0 dpf | Para Aramid 90/2-40/2 cc <1.0 dpf | Para Aramid 90/2-40/2 cc | Yarn sheet not crossing CMD yarns, end for end | Yarn sheet not crossing MD yarns, end for end | Plain weave End for end | Plain weave End for end | 15-30% | 15-30% | Ballistics |
| #2 Multi layer no connecting yarns | Para Aramid 400d = 3000d >1.0 dpf | Para Aramid 400d = 3000d >1.0 dpf | Para Aramid 90/2-40/2 cc <1.0 dpf | Para Aramid 90/2-40/2 cc <1.0 dpf | Yarn sheet not crossing CMD yarns, end for end | Yarn sheet not crossing MD yarns, end for end | Plain weave End for end | Plain weave End for end | " | " | " |
| #3 Multi layer no connecting yarns | UHMWPE 195d-3000d | UHMWPE 195-3000d | Para Aramid 90/2-40/2 cc <1.0 dpf | Para Aramid 90/2-40/2 cc <1.0 dpf | Yarn sheet not crossing CMD yarns, end for end | Yarn sheet not crossing MD yarns, end for end | Plain weave End for end | Plain weave End for end | " | " | " |
| #4 Multi layer no connecting yarns | PBO 200d-3000d | PBO 200d-3000d | Para Aramid 90/2-40/2 cc <1.0 dpf | Para Aramid 90/2-40/2 cc <1.0 dpf | Yarn sheet not crossing CMD yarns, end for end | Yarn sheet not crossing MD yarns, end for end | Plain weave End for end | Plain weave End for end | " | " | " |
| #5 Multi layer no connecting yarns | LCP 200d-3000d | LCP 200d-3000d | Para Aramid 90/2-40/2 cc <1.0 dpf | Para Aramid 90/2-40/2 cc <1.0 dpf | Yarn sheet not crossing CMD yarns, end for end | Yarn sheet not crossing MD yarns, end for end | Plain weave End for end | Plain weave End for end | " | " | " |
| #6 Multi layer no connecting yarns | PIPD 200d-3000d | M5 200d-3000d | Para Aramid 90/2-40/2 cc <1.0 dpf | Para Aramid 90/2-40/2 cc <1.0 dpf | Yarn sheet not crossing CMD yarns, end for end | Yarn sheet not crossing MD yarns, end for end | Plain weave End for end | Plain weave End for end | " | " | " |
| #7 Intimate blended staple | One or more of yarns from above | One or more of yarns from above | Intimate blended Fiber content >25% 10 gpd 90/2-40/2 cc | Intimate blended Fiber content >25% 10 gpd 90/2-40/2 cc | Yarn sheet not crossing CMD yarns, end for end | Yarn sheet not crossing MD yarns, end for end | Plain weave End for end | Plain weave End for end | " | " | " |
| #8 Multi layer no connecting yarns | One of yarns from above | One of yarns from above | One or more of yarns | One or more of yarns from | Yarn sheet not crossing | Yarn sheet not crossing | Plain weave End for end | Plain weave End for end | " | " | " |

TABLE 1-continued

| | | | | | | | | | | | |
|---|---|---|---|---|---|---|---|---|---|---|---|
| | plied with Para-Aramid 90/1-50/1 cc <1 dpf | plied with Para-Aramid 90/1-50/1 cc <1 dpf | from above | above | CMD yarns, end for end | MD yarns, end for end | | | | | |
| #9 Denser weave constructions, singles filling | One or more of yarns from above | One or more of yarns from above | One or more of yarns from above | One of above as singles 90/1-40/1 cc | Yarn sheet not crossing CMD yarns, end for end | Yarn sheet not crossing MD yarns, end for end | Plain weave End for end | 3 singles yarns weaving plain per cf yarn in CMD | " | 25%-40 | " |
| #10 Denser weave constructions, singles filling | One or more of yarns from above | One or more of yarns from above | One or more of yarns from above | One of above as singles 90/1-40/1 cc | Alter-nating sides of CMD cf yarns | Anter-nating sides of cf CM yarns | Plain weave End for end | 2 singles yarns weaving plain per cf yarn in CMD | " | 20%-35% | " |
| #11 Multi layer with connecting yarns | One or more of yarns from above | One or more of yarns from above | One or more of yarns from above | One or more of yarns from above | Multi sheet | Multi sheet | Plain weave + Multi layer connect | Plain weave + Multi layer connect | " | 15-30% | " |
| | High temp melt high ± coefficent of friction perferred | High temp melt high + coefficent of friction perferred | High temp melt high + coefficent of friction perferred | High temp melt high + coefficent of friction perferred | | | | | | | |
| #12 | Para Aramid 100d = 600d <1.0 dpf | Para Aramid 100d = 600d <1.0 dpf | Para Aramid 90/2-40/2 cc <1.0 dpf | Para Aramid 90/2-40/2 cc <1.0 dpf | Yarn sheet not crossing | Yarn sheet not, crossing | Plain weave | Plain weave | 35-70% | 35-70% | Ballistics and spike |
| #13 | PBO 100d-600d | PBO 100d-600d | Para Aramid 90/2-40/2 cc <1.0 dpf | Para Aramid 90/2-40/2 cc <1.0 dpf | Yarn sheet not crossing | Yarn sheet not, crossing | Plain weave | Plain weave | " | " | Ballistics and spike |
| #14 | LCP 100d-600d | LCP 100d-600d | Para Aramid 90/2-40/2 cc <1.0 dpf | Para Aramid 90/2-40/2 cc <1.0 dpf | Yarn sheet not crossing | Yarn sheet not, crossing | Plain weave | Plain weave | " | " | Ballistics and spike |
| #15 | PIPD 100d-600d | M5 100d-600d | Para Aramid 90/2-40/2 cc <1.0 dpf | Para Aramid 90/2-40/2 cc <1.0 dpf | Yarn sheet not crossing | Yarn sheet not, crossing | Plain weave | Plain weave | " | " | Ballistics and spike |

Notes for interpretation of the figures and abbreviations used elsewhere in the specification follows:

CMD=cross machine direction (web orientation)

MD=machine direction (web orientation)

gpd=grams per denier (tenacity)

dpf=denier per filament (fiber size)

end for end=one yarn of cf type and one yarn of sf type in the specified direction d=denier cc=cotton count <=less than >=more than cf=continuous filament sf=staple fiber UHMWPE=ultra high molecular weight polyethylene fiber, such as Dyneema®, Spectra® brands Para-Aramid=such as Kevlar®, Twaron®, Technora® brand fiber PBO=Poly(p-phenylene-2,6-benzobisoxazole), such as Zylon® brand fiber LCP=Liquid crystal polyester fiber such as Vectran® brand.

PIPD=poly{2,6-diimidazo[4,5-b4',5'-e]pyridinylene-1,4 (2,5-dihydroxy)phenylene} such as M5® brand fiber Higher fiber production costs strongly favor the cited methods and range of embodiments as the production of continuous high performance fiber has been optimized for the heavy deniers of 600-1500 range. In practice the yarns in the heavy denier group are not processed into webs at the stability limit. There is enough difficulty processing and handling these fibers at these limits, that the actual construction densities are higher in practice. The stability limit is not fully independent of denier. This effect makes the use of mixed fiber type weaving in accordance with the invention result in an even greater advantage when compared to the homogenous woven designs of the prior art.

In summary the composite yarn designs of the invention have the advantage of lower cost as compared to the exclusive use of heavy denier yarns. In addition, the staple yarn content improves the stability of these designs and lowers the cover factor for the stability limit. Taken together, these significant advantages allow for production of light weight fabrics at the minimum materials cost. In addition, heavy denier yarn is produced at higher rates and is less difficult to manufacture at high mechanical quality. These factors combine to improve the availability of heavy denier vs. light denier yarns, further confirming the advantage of the invention over the prior art.

The web designs that embody this invention require some special weaving techniques. The difference in yarn size makes the production of single standard warps very difficult. In the preferred embodiments, the two yarns, the higher denier primary yarn and the lower denier locking yarn, are produced on separate beams. The web production is then run from a double beam setup to achieve the embodiments described. Aside from the mastery required to execute these techniques at the requisite skill level, those familiar with the art will find this disclosure to be a fully enabling description of how to practice the claimed invention.

As seen in the micrograph of FIG. 1, the higher denier primary warp and fill yarns do not weave with respect to each other. The one and one pattern puts all the large fill yarn on one side of all of the large warp yarn. This is desirable from a ballistics perspective, although not a limitation of the invention, because the yarns act as a nearly continuous sheet which is able to more completely engage the projectile upon impact.

There are other and various embodiments within the scope of the invention. For example, there is a protective fabric consisting of a composite weave of staple yarn and continuous filament yarn, where the staple yarn is 5-50% by weight of the composite weave, and the continuous filament yarn is greater than 10 gpd.

The staple yarn and the continuous filament yarn may alternate in at least one of CMD and MD. The staple yarn and the continuous filament yarn may have equal end counts in CMD and equal end counts in MD. The staple yarn may have twice or even three times the end count of the continuous filament in at least one of MD and CMD. The staple yarn may be of smaller denier than the continuous filament yarn; and the fabric may have less than 30% cover in at least one of CMD and MD.

The continuous filament yarn may be configured as CMD and MD yarn sheets of continuous filament yarn, where the MD yarn sheet does not cross through the CMD yarn sheet. The staple yarn may be configured in a plain weave pattern interconnecting the MD yarn sheet and the CMD yarn sheet.

The staple yarn may consist of an intimate blend of filament types, at least 25% of the blend consisting of a filament type of at least 10 gpd. The staple yarn may include fibers of at least 10 gpd and fibers of at least 2 denier per fiber.

As another example, there may be a protective panel that consists of staple yarns and continuous filament yarns, with the continuous filament yarn configured in CMD and MD yarn sheets interconnected by the staple yarns into layers, where the staple yarn are 5-50% by weight of the panel and the continuous filament yarn is of greater than 10 gpd.

As yet another example, there is a composite protective fabric comprising staple yarn and continuous filament yarn, where the continuous filament yarn is configured as a MD primary yarn sheet and a CMD primary yarn sheet wherein the apparent cover factor of the two primary yarn sheets in combination is less than 21%. The staple yarn is configured in a plain weave pattern that interconnects the primary yarn sheets such that the total cover factor of the composite protective fabric is greater than 21%.

An additional example is a method for decelerating a ballistic projectile, which includes the step of positioning a fabric panel of multiple fabric layers in the path of the projectile, where the layers have a composite weave of continuous filament yarn and staple yarn, with each yarn including para-aramid type filament fibers. Each layer has an MD yarn sheet and a CMD yarn sheet of continuous filament yarn, and these sheets are interconnected by the staple yarn. The layers are arranged in sequence from an outermost layer facing the projectile through interior layers to an innermost layer.

A later step is to absorb sufficient energy from the projectile upon impact with the outermost layer and immediately adjacent interior layers to cause heating of the para-aramid filament fibers of the impacted continuous filament and staple yarn filament into a molten mass, thereby depositing the molten mass of fiber material and associated filaments of the staple yarn on the face of the projectile.

A step thereafter is to have the projectile transport the molten mass on its front end into the fabric panel, the additional material causing an increase of the coefficient of friction of the projectile as it continues.

The final step is to resist with interior layers of the panel the further penetration of said projectile and molten mass and associated filaments further into the fabric panel, absorbing all forward energy from the projectile prior to its piercing of the innermost layer.

A further example is a protective fabric with a composite weave of staple yarn and continuous filament yarn, where the staple yarn and the continuous filament yarn alternate in each of CMD and MD, the staple yarn is of not more than 200 denier, and the continuous filament yarn is of greater than 500 denier and 10 gpd. The fabric may have a plain weave with 20-25% cover and weight of less than 4 ounces per square yard. The staple yarn may have fibers of at least 10 gpd and at least 2 denier per fiber.

Still another example is a protective fabric having a composite weave of staple yarn and continuous filament yarn, the staple yarn and continuous filament yarn alternating in a repetitive pattern in CMD and in the same or another repetitive pattern in MD. The continuous filament yarn has fibers of at least 10 gpd. The staple yarn has less than half the denier of the continuous filament yarn. The resulting fabric weighs less than 4 ounces per square yard.

The continuous filament yarn may be within the range of 400 to 3000 denier. The staple yarn may be within the range of 80 to 180 denier. The composite weave may have a round cover factor of between 15 and 30%.

Alternatively, the continuous filament yarn may be within the range of 195 to 3000 denier, and the stable yarn may be within the range of 80 to 180 denier.

A yet further example is a protective fabric with a composite weave of staple yarn and continuous filament yarn, where the staple yarn and the continuous filament yarn alternate in a repetitive pattern in CMD and in the same or another pattern in MD. The continuous filament yarn has fibers of at least 10 gpd and ranging from 100-600 denier, and staple yarn ranges from 80-180 denier and has fibers of at least 2 denier for its hairiness effects. And the fabric ranges in composite cover factor between 35-70%.

Other examples and embodiments will be apparent to those skilled in the art, from the description and figures provided, and the claims that follow.

I claim:

1. A protective fabric comprising a flexible composite weave layer of staple yarn and continuous filament yarn, said staple yarn comprising 5-50% by weight of said composite weave, said continuous filament yarn being of greater than 10 gpd, said continuous filament yarn configured as CMD and MD yarn sheets of said continuous filament yarn, said MD yarn sheet not crossing said CMD yarn sheet, wherein the apparent cover factor of the CMD and MD yarn sheets in combination is less than 21%, said staple yarn comprising a hairiness of at least 50 protruding filament ends per inch, said staple yarn configured in a weave pattern interconnecting said MD yarn sheet and said CMD yarn sheet, said protruding filament ends of said staple yarn engaging intersecting said continuous filament yarns thereby contributing to stability of the composite weave layer, said composite weave layer having a weight of less than 4 ounces per square yard.

2. A protective fabric according to claim 1, said staple yarn and said continuous filament yarn alternating in at least one of CMD and MD.

3. A protective fabric according to claim 2, said staple yarn and said continuous filament yarn having equal end counts in CMD and equal end counts in MD.

4. A protective fabric according to claim 2, said staple yarn having twice the end count of said continuous filament in at least one of MD and CMD.

5. A protective fabric according to claim 2, said staple yarn having three times the end count of said continuous filament in at least one of MD and CMD.

6. A protective fabric according to claim 1, said staple yarn being of smaller denier than said continuous filament yarn.

7. A protective fabric according to claim 1, having less than 30% cover in at least one of CMD and MD.

8. A protective fabric according to claim 1, said staple yarn comprising an intimate blend of filament types, at least 25% of said blend comprising filament type of at least 10 gpd.

9. A protective fabric according to claim 1, said staple yarn comprising fibers of at least 10 gpd and at least 2 denier per fiber.

10. A protective panel comprising multiple flexible composite weave layers where a plurality of said composite weave layers comprises relatively lower denier staple yarn and relatively higher denier continuous filament yarn, said continuous filament yarn configured in CMD and MD yarn sheets interconnected by said staple yarn into layers where said staple yarn comprises 5-50% by weight of said panel and a hairiness of at least 50 protruding filament ends per inch, said protruding filament ends of said staple yarn engaging intersecting said continuous filament yarns thereby contributing to stability of the composite weave layer, said continuous filament yarn being of greater than 10 gpd.

11. A composite protective fabric assembly comprising multiple flexible composite weave layers of staple yarn and continuous filament yarn, said staple yarn comprising 5-50% by weight of said composite weave, said continuous filament yarn being of greater than 10 gpd, said continuous filament yarn configured as CMD and MD yarn sheets of said continuous filament yarn, said MD yarn sheet not crossing said CMD yarn sheet, wherein the apparent cover factor of the CMD and MD yarn sheets in combination is less than 21%, said staple yarn comprising a hairiness of at least 50 protruding filament ends per inch, said staple yarn configured in a weave pattern interconnecting said MD yarn sheet and said CMD yarn sheet, said protruding filament ends of said staple yarn engaging intersecting said continuous filament yarns thereby contributing to stability of the composite weave layer, said composite weave layer having a weight of less than 4 ounces per square yard.

12. A protective fabric assembly comprising multiple flexible composite weave layers wherein a plurality of the composite weave layers comprises staple yarn and continuous filament yarn, said staple yarn and said continuous filament yarn alternating in each of CMD and MD whereby said CMD and said MD continuous filament yarns are not crossing each other and have an apparent cover factor in combination of less than 21%, said staple yarn comprising yarn of not more than 200 denier and a hairiness of at least 50 protruding filament ends per inch, said protruding filament ends of said staple yarn engaging intersecting said continuous filament yarns thereby contributing to stability of the composite weave layers, said continuous filament yarn being of greater than 500 denier and 10 gpd, each layer of said plurality of layers having a plain weave with 20-25% cover and weight of less than 4 ounces per square yard.

13. A protective fabric assembly according to claim 12, said staple yarn comprising fibers of at least 10 gpd and at least 2 denier per fiber.

14. A protective fabric assembly comprising a plurality of flexible composite weave layers of staple yarn and continuous filament yarn, said staple yarn and said continuous filament yarn alternating in a repetitive pattern in CMD and in MD, said continuous filament yarn comprising fibers of at least 10 gpd, the denier of said staple yarn being less than half the denier of said continuous filament yarn, said layer weighing less than 4 ounces per square yard, the effective cover of the CMD continuous filament yarns in combination with the MD continuous filament yarns being less than 21%, the staple yarn comprising 5-50% by weight of its respective said layer and having at least 50 protruding filament ends per inch, said protruding filament ends of said staple yarn engaging intersecting said continuous filament yarns thereby contributing to stability of the composite weave layers.

15. A protective fabric assembly according to claim 14, said continuous filament yarn comprising denier within the range of 400 to 3000 denier, said stable yarn comprising denier within the range of 80 to 180 denier, said composite weave having a round cover factor of between 15 and 30%.

16. A protective fabric assembly according to claim 14, said continuous filament yarn comprising denier within the range of 195 to 3000 denier, said stable yarn comprising denier within the range of 80 to 180 denier, said composite weave having a round cover factor of between 15 and 30%.

17. A protective fabric assembly according to claim 14, said staple yarn having twice the end count of said continuous filament in at least one of MD and CMD.

18. A protective fabric assembly according to claim 14, said staple yarn having three times the end count of said continuous filament in at least one of MD and CMD.

19. A protective fabric assembly according to claim 14, said staple yarn comprising an intimate blend of filament types, at least 25% of said blend comprising filament type of at least 10 gpd.

20. A protective fabric soft panel assembly comprising multiple layers of a composite weave of relatively lower denier staple yarn and relatively higher denier continuous filament yarn, said staple yarn and said continuous filament yarn alternating in a repetitive pattern in CMD and in MD, said continuous filament yarn comprising fibers of at least 10 gpd and ranging from 100-600 denier, said staple yarn ranging from 80-180 denier and comprising fibers of at least 2 denier, said fabric ranging in composite cover factor between 35-70% said staple yarn comprising a hairiness of at least 50 protruding filament ends per inch, said protruding filament ends of said staple yarn engaging intersecting said continuous filament yarns thereby contributing to stability of the composite weave.

* * * * *

UNITED STATES PATENT AND TRADEMARK OFFICE

CERTIFICATE OF CORRECTION

PATENT NO. : 7,514,378 B2
APPLICATION NO. : 11/071141
DATED : April 7, 2009
INVENTOR(S) : Charles A. Howland It is certified that error appears in the above-identified patent and that said Letters Patent is hereby corrected as shown below:

Column 1
Line 4, insert -- STATEMENT OF GOVERNMENT INTEREST
This invention was made with Government support under (W911QY-05-0078 and W911QY-06-0105) awarded by the U.S. Army. The Government has certain rights in the invention. --

Signed and Sealed this

Ninth Day of June, 2009

JOHN DOLL
*Acting Director of the United States Patent and Trademark Office*